US006079188A

United States Patent [19]

Katayama et al.

[11] Patent Number: 6,079,188

[45] Date of Patent: Jun. 27, 2000

[54] PACKAGING CONTAINER PRODUCTION EQUIPMENT AND PACKAGING CONTAINER PRODUCTION METHOD

[75] Inventors: Hiroshi Katayama; Akimasa Fujimoto; Michio Ueda, all of Itano-gun, Japan

[73] Assignee: Shikoku Kakoki Co., Ltd., Japan

[21] Appl. No.: 09/084,174

[22] Filed: May 26, 1998

[30] Foreign Application Priority Data

May 30, 1997 [JP] Japan ..... 9-141537

[51] Int. Cl.[7] ..... B65B 9/06; B65B 57/02

[52] U.S. Cl. ..... 53/451; 53/51; 53/64; 53/389.2; 53/551

[58] Field of Search ..... 53/51, 551, 389.2, 53/389.4, 64, 451; 226/28, 29, 30, 31, 44; 242/417.3, 418.1; 493/23, 29

[56] References Cited

U.S. PATENT DOCUMENTS

| | | | |
|---|---|---|---|
| 2,636,732 | 4/1953 | Howard | 53/551 |
| 3,116,032 | 12/1963 | Roberts | 242/417.3 |
| 3,417,674 | 12/1968 | Abrahamson | 53/51 |
| 3,787,001 | 1/1974 | Henry | 53/51 |
| 4,033,522 | 7/1977 | Chestnut et al. | 242/418.1 |
| 4,074,504 | 2/1978 | Greenwalt et al. | 53/551 |
| 4,129,238 | 12/1978 | Herd | 226/29 |
| 4,262,474 | 4/1981 | Reuter et al. | 53/551 |
| 4,566,253 | 1/1986 | Jones | 53/551 |
| 5,317,858 | 6/1994 | Hanai | 53/551 |
| 5,480,085 | 1/1996 | Smithe | 242/418.1 |

*Primary Examiner*—John Sipos
*Attorney, Agent, or Firm*—Lorusso & Loud

[57] ABSTRACT

The action pattern of the amount of web feeding by the lug folding flaps is made optimal in accordance with deviations of detection marks, such as specified printing patterns on the printing surface on web W, from the reference values when they are detected, and the pressing force applied onto web W by dancer roller 9 is stepwise or continuously adjusted according to the detection of the patterns. Therefore, in comparison with the conventional examples, it is possible to widen the corrective range for the amount of web feeding. Thus, the tolerance for printing errors on web W can be increased, and it is possible to operate the equipment without stopping. Furthermore, it is possible to produce packaging containers with printing patterns applied at appointed positions, and faulty products are eliminated.

12 Claims, 12 Drawing Sheets

W
W
7c
7c
7c
7c
A°
B°
0.5mm
1.0mm
REFERENCE FEEDING AMOUNT

REFERENCE
0.5mm
1.0mm
1.5mm
① ② ③

REFERENCE
0.5mm
1.0mm
1.5mm

REFERENCE
0.5mm
1.0mm
1.5mm
① ... USUAL FEEDING ACTION
② ... USUAL FEEDING ACTION
③ ... CORRECTIVE FEEDING ACTION

PACKAGING CONTAINER PRODUCTION EQUIPMENT AND PACKAGING CONTAINER PRODUCTION METHOD

TECHNICAL FIELD

The present invention relates to packaging container producing equipment and a packaging container producing method, in particular to packaging container producing equipment and a packaging container producing method of forming a sheet-like web into a tubular web and filling said tubular web with contents such as fluid food.

BACKGROUND ART

In packaging container producing equipment for producing packaging containers, into which a content is filled, from sheet-like web, rolled sheet-like web W of rewinder 1 is transferred by web feeding roller 10 and is sent to tube forming device 3 via tension pressing device 2 consisting of a dancer roller (rocking roller) 9, which gives tension to the above-mentioned web W at all times, and guide roller 11, wherein the sheet-like web W is formed into tubular web W by multiple stages of forming rollers 14 (only one stage is illustrated in FIG. 1), and the edges overlapped in the lengthwise direction of the tubular web W are sealed (longitudinally sealed) in the longitudinal direction. Furthermore, after a part of web W is sealed (cross-sealed) in the direction orthogonal to the lengthwise direction of web W, a content is filled into the tubular web W located at the upstream side of the cross-sealed part, and after cross sealing is further carried out at a length equivalent to one container in the above-mentioned web, said cross sealed part is cut off, whereby a hexahedral packaging container is produced with the contents filled therein.

The tube forming device 3 is provided with a filling pipe 5 to fill a section of the tube with contents such as fluid food, etc., and is provided with a pair of seal jaws 7 (only one jaw 7 is illustrated in FIG. 1), in order to seal the tubular web W from opposing sides of the tubular web W via a drive mechanism (not illustrated) operated from the main shaft 6 of the packaging container producing equipment.

A pair of cross seal jaws 7 moves downwards while pulling the tubular web W downwards. After the seal jaws 7 move down a predetermined distance, they release the web W to cancel the downward transfer force on the tubular web W and move to separate from each other. Then, the seal jaws 7 are elevated the predetermined distance and repeat their sealing action on the tubular web W again.

As shown in a detailed view (only one of the pairs is illustrated in this drawing) of the cross seal jaws 7 of FIG. 3, the above-mentioned cross seal jaws 7 are provided with jaws 7*b* attached to a horizontal bar 7*a*, and web is nipped between a pair of jaws 7*b* to cause a cross sealing to be executed. Furthermore, lug folding flaps 7*c* rotating in the direction of the arrow A are attached to one of the cross seal jaws 7, wherein while web W is nipped between a pair of jaws 7*b*, the above-mentioned lug folding flaps 7*c* are able to fold lugs Wb formed in the web W.

Specified printing patterns and detection marks a (See FIG. 4), such as a straw port for registering positions are provided at appointed intervals on the web W. Using the position of the above-mentioned detection mark a as reference, it is necessary to adjust the feeding amount of web W (this is called "mark registration") in packaging container producing equipment so that detection marks a of printing surface for each packaging container C come to an appointed position.

However, since errors in positioning of patterns and straw ports when printing on sheet-like web and changes of the feeding amount of web W due to defective rotations of rollers in the packaging container producing equipment are unavoidable, it is necessary to register the above-mentioned marks at all times while the packaging container producing equipment is in operation. If the feeding amount becomes such that it can not be adjusted by registering the above-mentioned marks, there are cases where packaging containers C which are the final formed products can not be formed to their intended shape.

Mark registration is carried out by combination of (1) a method of adjusting the folding amount of web W in its transfer direction and (2) a method of adjusting the degree of tension applied to web W being transferred.

(1) Method of adjusting the folding amount of web W in its transfer direction (See FIG. 11)

The feeding amount of web W in the transfer direction is adjusted in two stages of action, wherein the first action is to adjust the feeding amount of web W in the transfer direction by a pulling force of web W, and the second action adjusts the folding angle of a lug portion formed on web W. By combining these methods, the web W is transferred in the web transfer direction.

The mechanical feeding action of web W in the transfer direction consists of the following two actions shown in FIG. 11.

① By the sealing part of web W being nipped at both sides by a pair of cross seal jaws 7, the mechanical feeding action is carried out by pulling the web W equivalently to the moving distance of the cross seal jaws 7 in the web transfer direction (See FIG. 11(*a*)). The drive of a pair of cross seal jaws 7 consisting of two sets is repeated as shown by the arrow R in FIG. 11, wherein a pair of cross seal jaws 7 consisting of two sets repeat this action alternately, web W can be continuously transferred.

② The shape of web W taken along the line A—A in FIG. 11(a) is as shown in FIG. 11(*b*), and the lug part web Wb (See FIG. 12) is folded, as shown in FIG. 11 (*c*), from both sides of tubular web W in the right angle direction with respect to the cross seal part Wa formed by the above-mentioned action (i).

The above-mentioned actions ① and ② are basically for applying cross sealing to tubular web W, folding a lug part formed at the cross sealed part and finally forming a hexahedral body. However, by adjusting the folding angle of the lug folding flaps 7*c*, it is possible to adjust the feeding amount of web W.

(2) Method of adjusting the degree of tension applied to web W being transferred.

In order to accurately move web W only an appointed distance without fail by the method of adjusting the web feeding amount based on adjustment of the folding angle by the lug folding flaps 7*c* of the above-mentioned action (1), it is necessary give adequate fixed tension to web W by tension pressing device 2 (FIG. 1). For example, if the tension of web W is too much, a mechanical slip occurs between web W and its feeding members, thereby causing the amount of movement of web W to be decreased. To the contrary, if the web tension is too weak, the web is slackened to cause the web W to be transferred beyond that necessity. Thus, appointed tension is given to web W so that the proper amount of web W being transferred is neither too much nor too little.

By combination of this method (2) and the above-mentioned method (1), the mark registration is carried out.

Correction of the amount of feeding is carried out by the lug folding flaps 7*c* while applying appointed tension to the web for a slight change (for example, 1% of the prescribed value) of the feeding amount of web W. However, the appointed tension control by a tension pressing device was carried out by only the pressing force in the direction of gravity due to the self weight of the dancer roller 9 shown in FIG. 1.

However, if the printing patterns of packaging containers which are the final products slip from their proper positions, the container become worthless. Therefore, it is necessary that a change (error) of the feeding amount of web W, for example, the average error of each time for 100 pitches of web feeding action equivalent to one packaging container C, is less than an appointed value (for example, 0.5 mm or less) and a change (error) of the feeding amount of web per pitch of the web feeding action equivalent to one packaging container C does not exceed an appointed value (for example ±1.5 mm).

Furthermore, the more the roll-like web W is consumed, the more frequently occurs a case where a slip of the detection marks in the transfer direction exceeds the permissible range of correction of the mark registration, whereby it becomes impossible to correct the feeding amount of web W.

Thus, in the prior art, since the allowance for the feeding amount of web W is narrow, there was a problem in that it was difficult to adjust the feeding amount of web W with the machine continuously operating.

It is an object of the invention to improve the deficiencies of the prior art.

It is therefore an object of the invention to increase the correctable allowance of error in mark registration of detection marks such as printing patterns on web W.

Furthermore, it is another object of the invention to widen the range for correction of the web feeding amount, so that products do not become defective even though a change (error) in the feeding amount of web W is larger than before.

Furthermore, it is still another object of the invention to provide equipment and a method for producing packaging containers having high quality by increasing the range for adjustment of the feeding amount of web W using, as a reference, the positions of detection marks, which will be signs on the web W, as references.

SUMMARY OF THE INVENTION

The above-mentioned objects of the invention are achieved by a packaging container making apparatus for forming tubular web from sheet-like web and producing hexahedral packaging containers. The apparatus of the invention includes a web tension pressing means provided with a rocking arm and a rocking roller secured at the tip end thereof, which transfers sheet-like web while pressing the sheet-like web by the rocking roller; a web tension pressing force setting means for setting the pressing force of said tension pressing means; a sealing member for sealing transverse portions of the tubular web by pressing both sides of the tubular web while folding both the sides of said tubular web in the direction orthogonal to the lengthwise direction of the tubular web obtained from the sheet-like web; a mark detecting means for detecting presence of specified detection marks or targets on the web at points of detection established in advance; a folding amount setting means of said sealing member, by which the amount of folding by the sealing member is set to a plurality of stages; a folding amount controlling means of said sealing member, for selecting an optimal action from a plurality of stages of set values of said folding amount setting means of said sealing member, in response to a deviation between a reference timing for when said mark detecting means detects a specified detection mark on the web at a point of detection, and the actual timing when a specified printing detection mark is detected at said specified point of detection; and a web tension pressing force controlling means for stepwise or continuously adjusting the pressing force set value of said web tension pressing force setting means to an optimal value in response to actions selected by the folding amount controlling means of the sealing member.

The present invention also provides a packaging container production method for forming tubular web from sheet-like web and producing hexahedral packaging containers from the above-mentioned tubular sheet-like web. The method of the invention includes transferring the sheet-like web while controlling a tension pressing force to an optimal value with respect to the sheet-like web; forming tubular web from the sheet-like web being transferred; nipping opposing sides of the tubular web along a direction orthogonal to the lengthwise direction said tubular web and forming a sealing part in the tubular web by folding the same; selecting and executing, from a plurality of actions established in advance, the amount of folding of said opposing sides of the web in compliance with the deviation between the timing when a specified detection mark, used as a target on the web, reaches the point of detection which is a specified reference established in advance and the timing when the specified detection mark is actually detected at said point; and controlling the tension pressing force for said sheet-like web to an optimal value in compliance with said selected action.

A sealing member according to the invention is composed of a pair of first sealing members for sealing the opposing sides of the tubular web in a direction orthogonal to the lengthwise direction of the tubular web and second sealing members for folding a lug of web formed by said first sealing members. The folding amount setting means of the sealing member is constructed so as to set a value which ensures a normal feeding action by which the folding amount of the second sealing member is set at a first appointed angle and a corrective feeding action by which the folding amount of the second sealing member is set at a second appointed angle. The folding amount controlling means of the sealing member selects a normal feeding action consisting of a specified feeding amount exceeding the reference feeding amount or a corrective feeding action consisting of a specified set feeding amount below the reference feeding amount in compliance with the timing when a specified detection mark used as a target on web is detected by the mark detection means, and is able to control the amount of web feed by the sealing members.

The web tension pressing force controlling means may be provided with a pressing force changer mechanism which changes the set value of the web tension pressing force setting means to a set value when the corrective feeding actions by the second sealing means are carried out more frequently than an appointed frequency, and changes the set value thereof to a lower set value when the corrective feeding actions are carried out less frequently than an appointed frequency.

A tension pressing force setting means used in the above-mentioned packaging container producing equipment according to the invention employs a pneumatic cylinder or a hydraulic cylinder equipped with a pressure changer feature, which generates a plurality of stages of pressure levels to press the rocking roller (dancer roller), and an electropneumatic proportional valve which continuously (stagelessly) generates pressure proportionate to the electric signals.

Thus, according to the invention, since the pressing force on web W by the tension pressing device and/or the folding amount of web W by a pair of sealing members in the tube forming device are controlled in compliance with the deviation of the detection mark (specified printing patterns or straw port) on the web W from the reference value, the feeding amount of web W can be adjusted.

It is preferable that the deviation of the detected value of specified detection marks on web W from the reference values be based on the deviation between a set reference set value for the angle of rotation or the number of rotations of the main shaft of the packaging container producing equipment and the detected registration of the detection marks. This is because the movement of almost all the drive parts of the packaging container producing equipment such as cross seal jaws, container forming conveyor, etc., depend upon the angle of rotation or the number of rotations of the main shaft. However, instead of depending the rotational angle or number of rotations of the main shaft, the deviation of the detected value of the above-mentioned specified detection marks from the reference value may be measured on the basis of rotation of other drive components.

The web feeding by sealing members (for example, lug folding flaps) consists of the above-mentioned normal feeding mode and the corrective feeding mode and control is by selectively combining actions of the normal feeding mode and the corrective feeding mode and controlling the pressure (pressing force) applied to web W by a rocking roller (dancer roller), wherein the range for correction is larger in comparison with the corrective range of the conventional method without using adjustment by means of web tension pressing force.

The invention is further provided with, in addition to the above-described adjustment method and components for feeding the web W, position detecting means for detecting the upper limit and lower limit positions of a dancer roller pivoting in the vertical direction and the capability of changing the feed of the sheet-like web between a high-speed and low-speed modes of operation of the feeding roller responsive to detection of the upper limit and lower limit positions of the dancer roller of each of the above-mentioned position detection means. These latter features further widen the range for adjustment of the web feeding amount.

Thus, with the present invention, it is possible to increase the range of correction for the web W feeding amount relative to the conventional corrective range of the web W feeding amount. Therefore, problems such as printing deviations on web W can be further addressed to ensure that continuous operation is enabled, i.e., without stopping the machine. Furthermore, it is possible to produce packaging containers on which printing patterns are correctly placed at predetermined locations and, accordingly, it is possible to decrease the number of faulty products.

DESCRIPTION OF THE PREFERRED EMBODIMENTS

Figure 1:
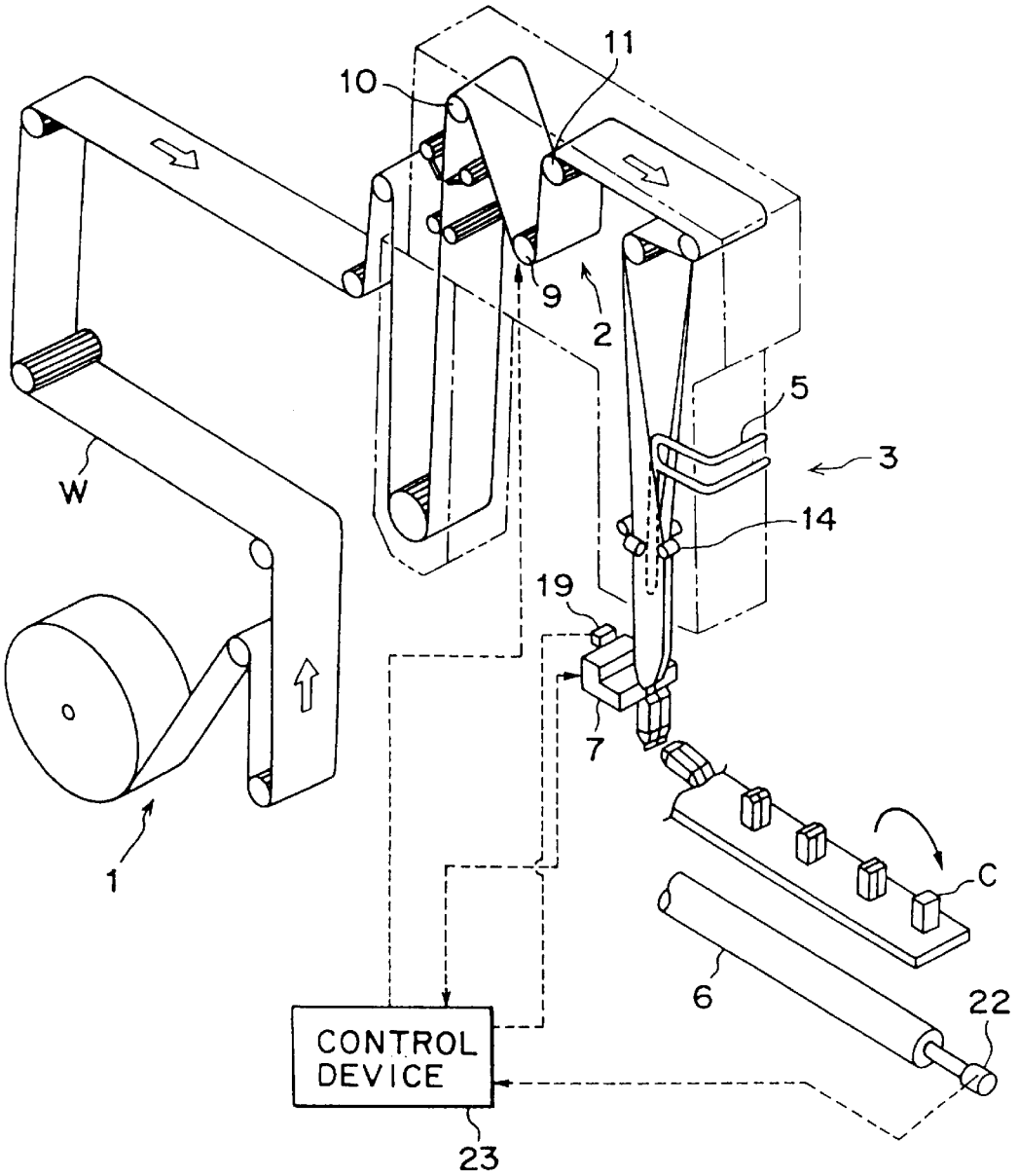
FIG. 1 is a schematic diagram of an apparatus for producing packaging containers, in which a content is filled, from sheet-like web, according to a preferred embodiment of the invention.
Figure 2:
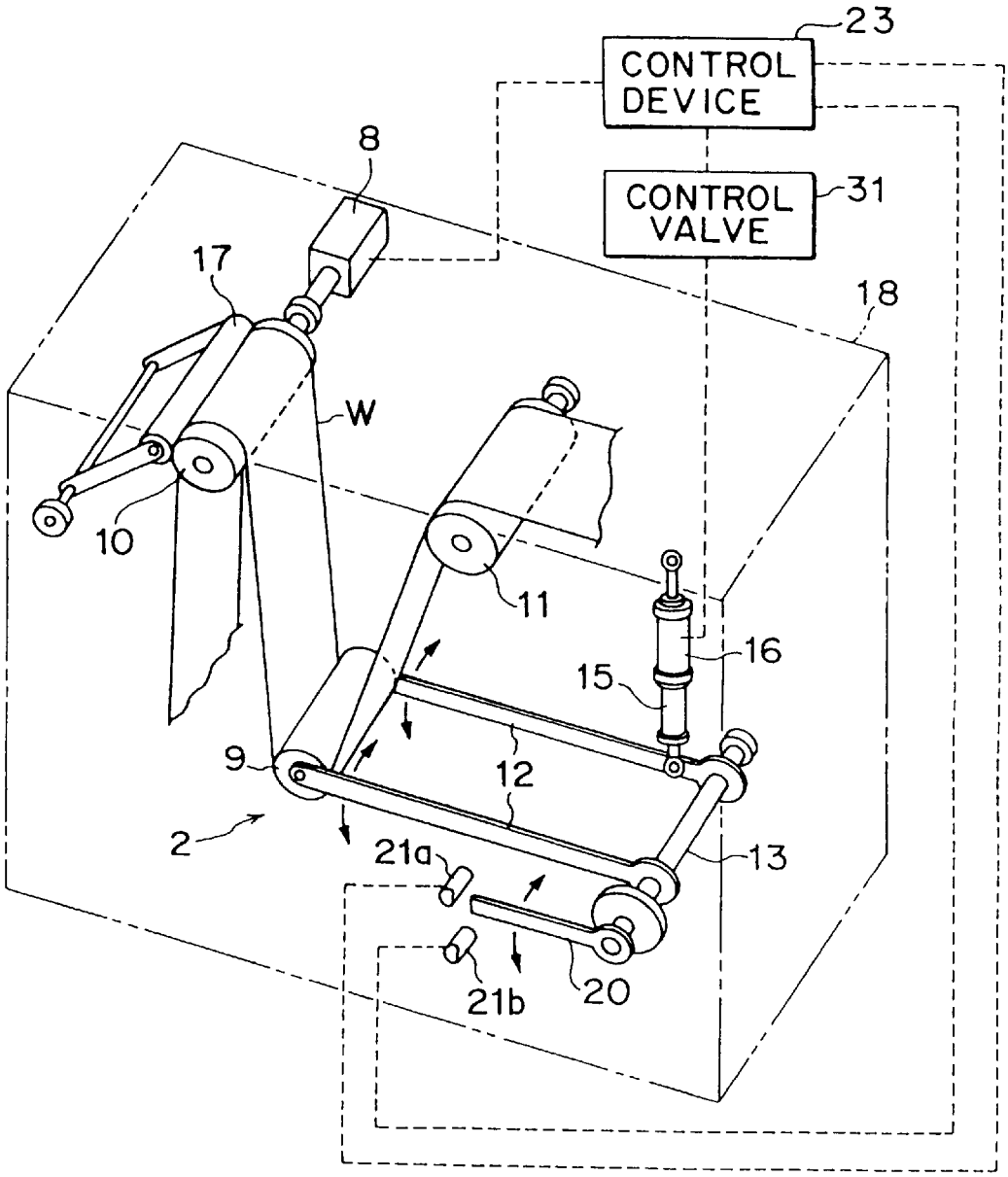
FIG. 2 is a rough perspective view of a tension pressing device of the packaging container producing apparatus of FIG. 1.
Figure 3A:
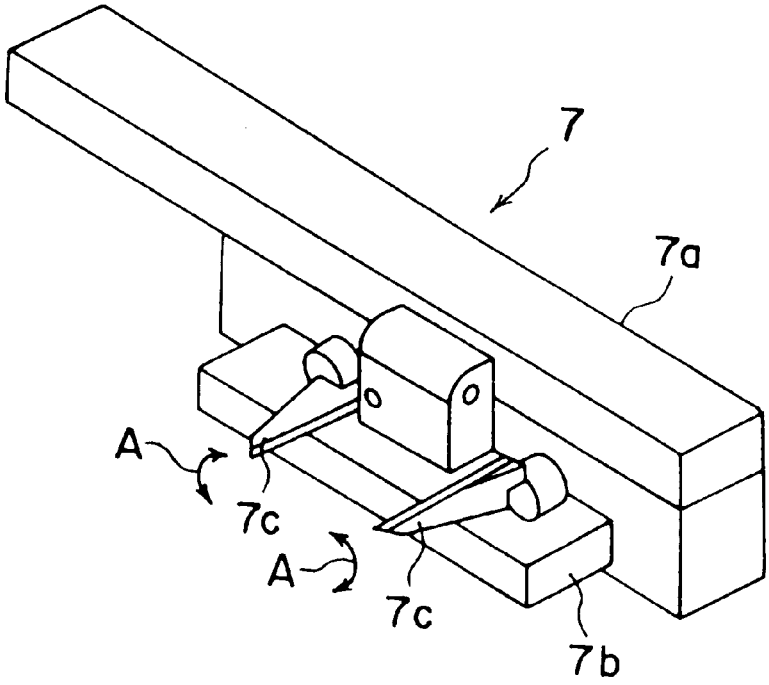
FIG. 3*a* is a perspective view of cross seal jaw of the packaging container producing apparatus of FIG. 1.
Figure 3B:
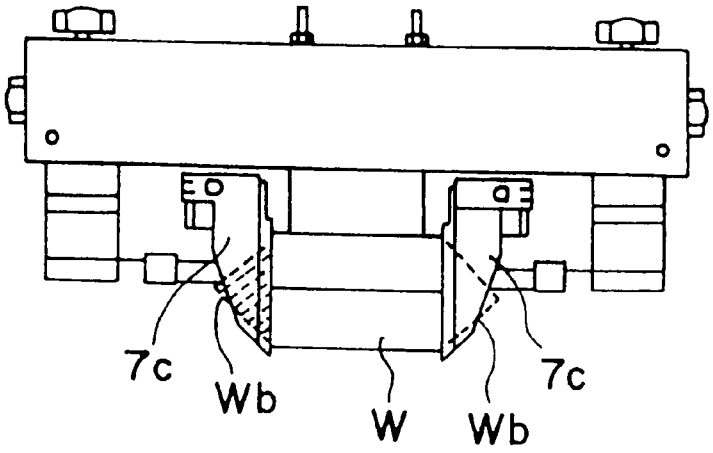
FIG. 3*b* is a top plan view thereof.
Figure 4:
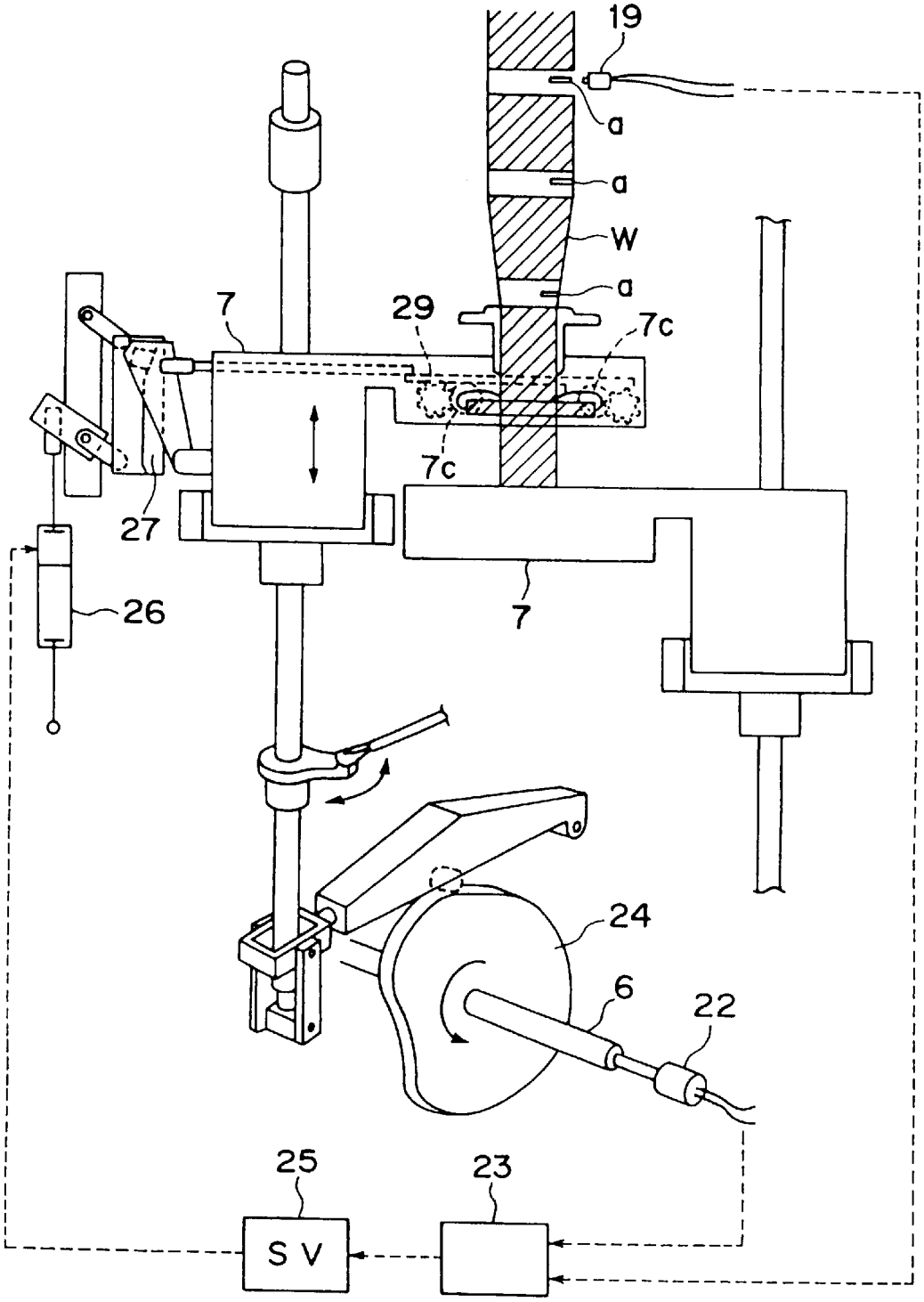
FIG. 4 is a schematic view explaining a mechanism for mark registration by adjustment of the amount of web folded by the cross seal jaw of the packaging container producing apparatus of FIG. 1.
Figure 5:
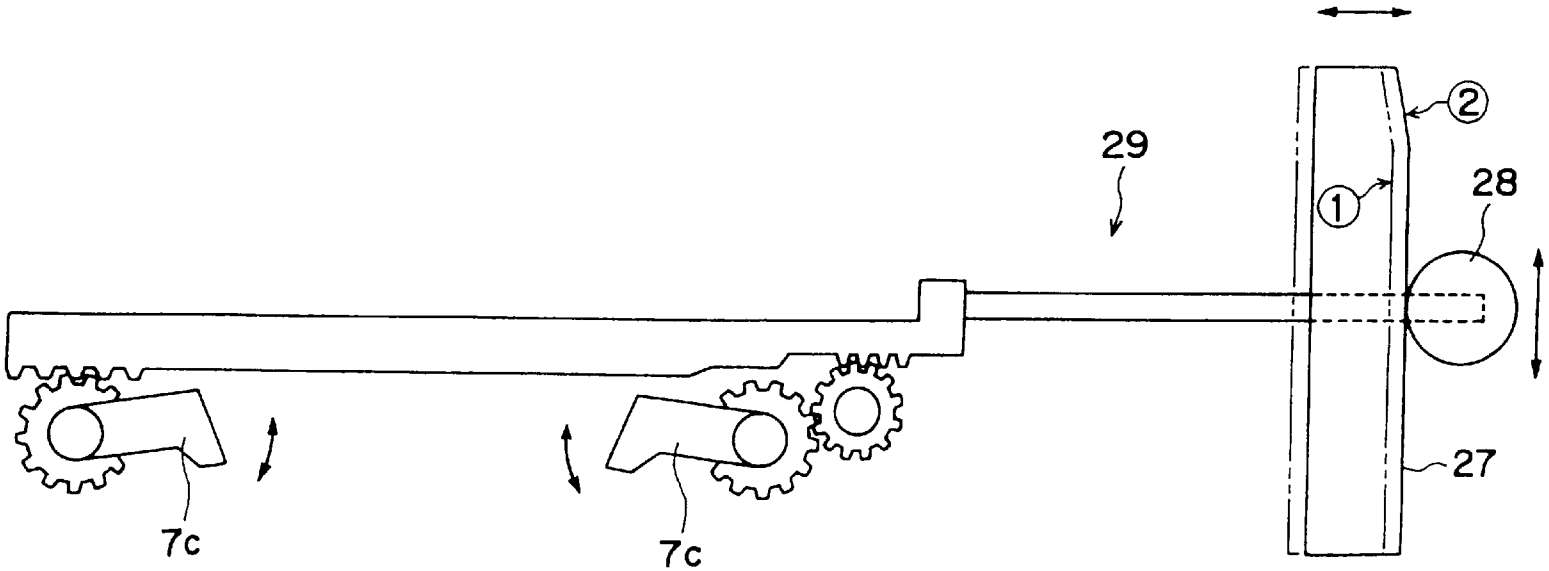
FIG. 5 is a schematic view explaining a flap drive section of the mechanism of FIG. 4.
Figure 7:
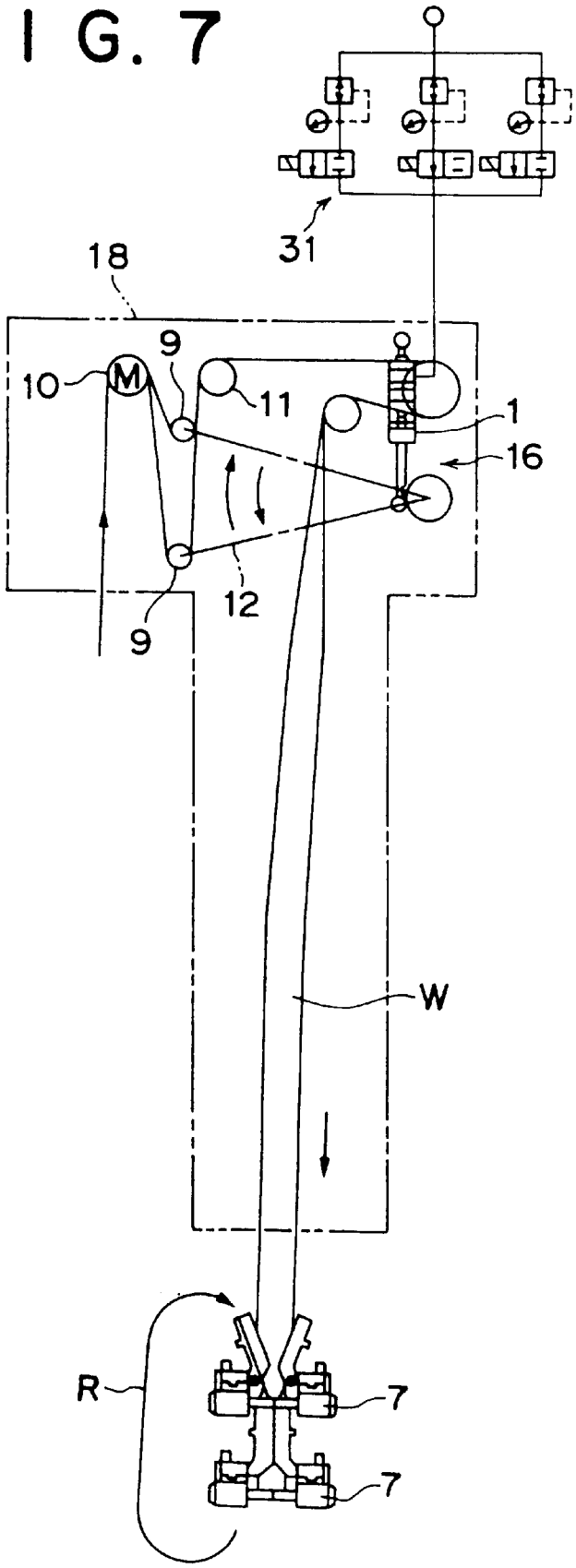
FIG. 7 is a schematic diagram of the tension pressing device and cross seal jaw of the packaging container producing apparatus of FIG. 1.

The packaging container producing apparatus according to a preferred embodiment of the invention is composed of the same construction as the packaging container producing equipment described in FIG. 1, excepting the major parts. FIG. 2 is a sketch of a tension pressing device for tensioning the web W being transferred, which is not illustrated in FIG. 1. FIG. 3(*a*) is an enlarged perspective view of web cross seal jaws 7, and FIG. 3(*b*) is a top view thereof. FIG. 4 is a view of a drive mechanism for folding lug flaps responsive to detection of specified printing patterns or specified detection marks such as a straw port on web W. FIG. 5 is a sketch of the major portions of the drive for folding lug flaps, and FIG. 7 is an explanatory view of a mechanism compensating for printing error (deviation in mark registration).

Figure 12:
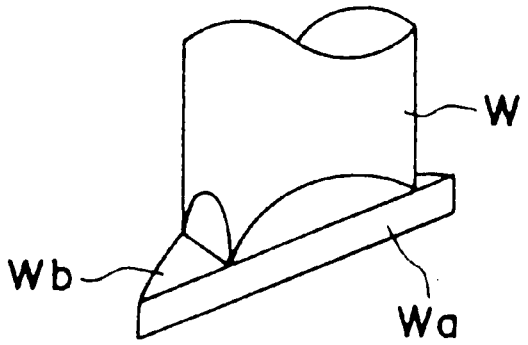
FIG. 12 (PRIOR ART)
FIG. 12 is a perspective view of the cross-sealed portion of the tubular web.

The packaging container producing equipment shown in FIG. 1 is as described above, wherein tubular web W is transferred while being pulled by a pair of cross seal jaws 7 during a downward movement thereof, in the process of pressing said web W by a pair of cross jaws 7 along a direction orthogonal to the lengthwise direction of the tubular web W. At this time, while web Wa (FIG.12) is being nipped between a pair of jaws 7*b* of the cross seal jaws 7, lug folding flaps 7*c* fold the lugs Wb formed at web W.

Therefore, tubular web W is transferred downward and folded while the web W is nipped by a pair of cross seal jaws 7 in the tube forming device 3. However, after the pair of cross seal jaws 7 carry out feeding of web W for an appointed distance while moving downward, they repeat an upward movement. In practice, two pair of cross seal jaws 7 are provided as shown in FIG. 7, wherein after they feed web W downward for an appointed distance, they repeat a returning movement to the original position as shown by the arrow R in FIG. 7.

On the other hand, the tension pressing device 2 controls the feedrate and feeding amount of web W inside the packaging container producing apparatus or continuously applies tension to the web W. Formability is worsened and the web feeding amount becomes unstable unless tension is applied to the web when the filled tubular web is formed into a square-column-like web W by forming members (not illustrated).

FIG. 2 is a perspective view of tension pressing device 2. The tension pressing device 2 includes a dancer roller (rocking roller) 9 which is disposed between a feeding roller 10 driven by drive means 8, having a clutch, to transport the web W and a guide roller 11 and is rockable in a direction almost orthogonal to the web transfer direction. Tensioning device 2 further includes a pair of rocking arms 12 which carry the above-mentioned dancer roller at their distal ends and allow the dancer roller 9 to rock in a direction almost orthogonal to the web transfer direction. A rotating shaft 13 is secured at the base of the above-mentioned pair of rocking arms 12, for transmitting a drive force to the rocking arms 12 from a pneumatic cylinder 16 (or a hydraulic cylinder or motor) via member 15.

The pneumatic cylinder 16 is provided with a control valve 31 for controlling the air pressure in multistage in compliance with the timing of detection of a detection mark a (FIG.4). An electro-pneumatic proportional valve, etc. which is able to continuously adjust the tension pressing force on the web may be employed.

Furthermore, a pressing roller 17 transmits a transfer force to the web being transported by the feeding roller 10 and the feeding roller 10 is fixed in the position opposite the feeding roller 10.

As shown in FIG. 2, although the rotating shaft (not illustrated) of the feeding roller 10 and guide roller 11 is supported at the wall of germfree chamber 18, the dancer roller 9 is not supported at said wall. The dancer roller 9 is able to rock in a direction almost orthogonal to the feeding direction of web W with respect to rocking of the rocking arm 12.

However, in order to solve a problem such as a printing error on web W, as explained above, there are two methods, that is, (1) a method of adjusting the amount of web W foled in the transfer direction, and (2) a method of adjusting the tension pressing force imposed on web W by the tension pressing device 2.

(1) Method of adjusting the amount of folding of web w in the transfer direction This embodiment employs a method of changing the folding angle of lug folding flaps 7*c* provided on only one cross seal jaw 7 of a pair of cross seal jaws 7.

A detector 19 for detecting a mark a such as a specified printing pattern, straw port, etc., is installed, as shown in FIG. 4, at a specified point established in advance in packaging container producing apparatus. Data signals for detection of a mark a of web W of the above-mentioned detector 19 and cam rotation angle signals of an encoder 22 for detecting the rotational angle of the main shaft 6, to which a cross seal jaw drive cam 24 is attached, are input into a control device 23. The rotational angle of shaft 6 which is detected at the point when the data signal of the above-mentioned detection mark a is read, is regarded as a detection angle of the detection mark a in the above-mentioned control device 23, and a deviation between the detection angle of the above-mentioned detection mark a and the reference angle established in advance is obtained. A value corresponding to the deviation is output, via a solenoid valve 25, to the pneumatic cylinder 26 for adjusting the amount of folding by lug folding flaps 7*c* (FIG.3) of the cross seal jaws 7.

As shown in FIG. 5, lug folding cam 27 is moved between positions ① and ② by the pneumatic cylinder 26. Since a roller 28 moves on the cam surface when the lug folding cam 27 is at the position ①, the lug folding flap 7*c* carries out a corrective action of folding to the position shown in FIG. 8 (*b*), and since the roller 28 moves on the cam surface when the lug folding cam 27 is at the position ②, the lug folding flaps 7*c* carries out a normal feeding action of folding to the position shown in FIG. 8(*a*).

Figure 6:
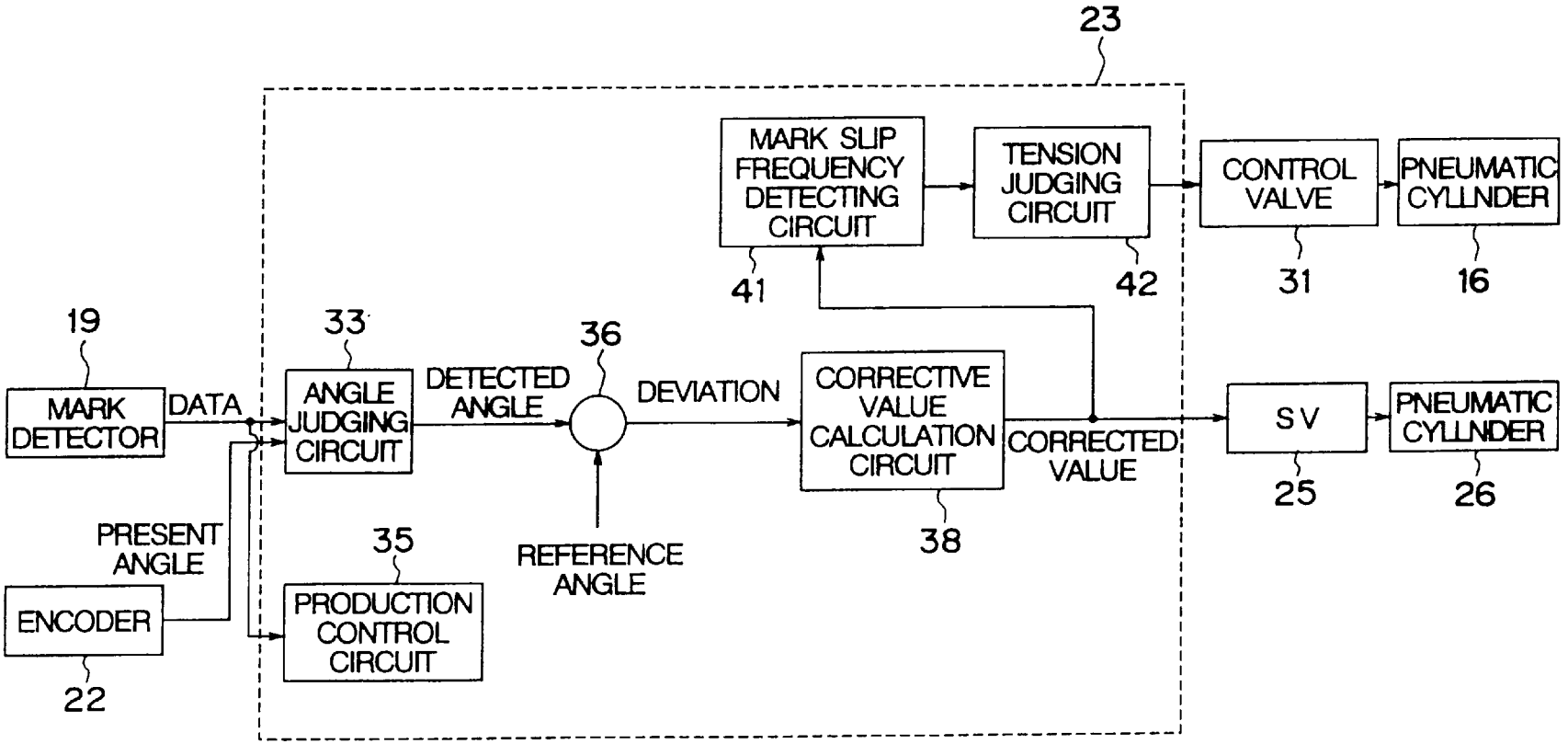
FIG. 6 is a block diagram of a control device for control of a tension pressing force of the packaging container producing equipment of FIG. 1 and of the amount of web folding by the cross seal jaw.

With reference to FIG. 6, operation of a control device which adjusts the amount of folding the above-mentioned cross seal jaw 7 into the web W transfer direction by the lug folding flaps 7*c* will now be described.

Data of web W detection mark a, which is detected by the detector 19, is input into main shaft rotation angle judging circuit 33 of the control device 23. Furthermore, the rotational angle of the main shaft 6 detected by the encoder 22 is input into the main shaft rotational angle judging circuit 33. The main shaft rotational angle judging circuit 33 regards the rotational angle of the main shaft, which is detected at the point in time when the data of detection mark a read by the detector 19 is input, as a mark detection angle. Furthermore, the data of the detector 19 is also input into a production control circuit 35, which is used as data for production control.

The detection angle of the main shaft 6 is input into a subtracter 36 along with the reference angle (the rotational angle established as a reference in advance) and the subtracter 36 determines any deviation between the detection angle and reference angle and outputs a deviation value to a corrective value calculation circuit 38. In the corrective value calculation circuit 38, a corrective value corresponding to the above-mentioned deviation value is obtained, and an electric signal corresponding to the corrective value thus obtained is output from the control device 23 to a solenoid valve 25 which drives the pneumatic cylinder 26 (FIG. 4) so that the lug folding flap 7*c* carries out either a normal feeding action or a corrective feeding action in order to obtain an adequate feeding amount of web W.

The lug folding angle of web W of the lug folding flaps 7*c* is established from a deviation between the detection angle of the detection mark a by the detector 19 and the reference angle in such a manner that a normal feeding action which produces a web feeding amount obtained by adding only 0.5 mm to the reference feeding amount is employed until a detection value equivalent to the value obtained by adding only 1.5 mm to the reference feeding amount is obtained as the web feeding amount, and as the detection value equivalent to a value obtained by adding only 1.5 mm to the reference feeding amount is obtained for the web feeding amount, a corrective feeding action which produces a web feeding amount obtained by subtracting only 1.0 mm from the reference feeding amount is employed.

Figures 8A, 8B:
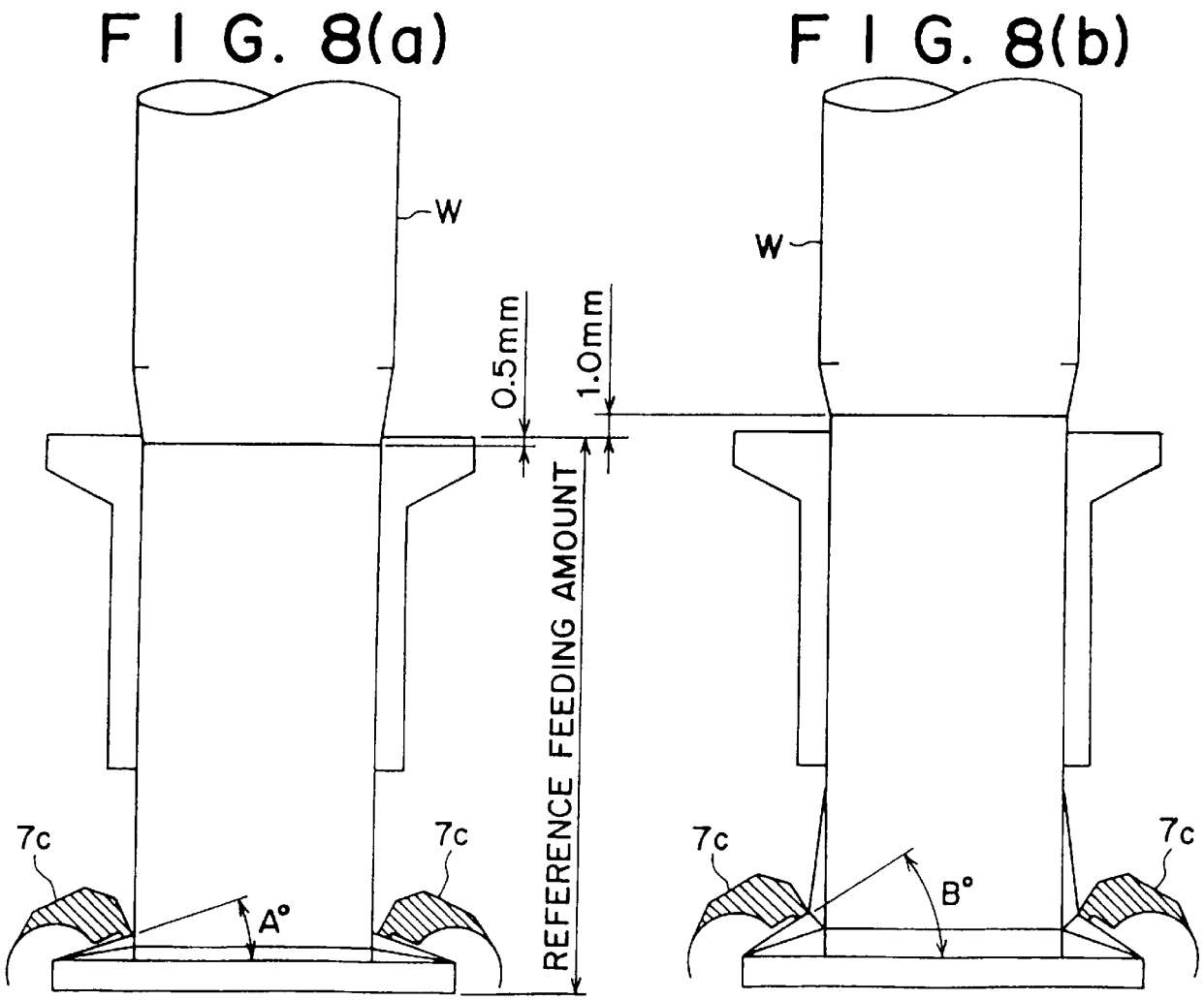
FIG. 8*a* is a view explaining a usual feeding action of the cross seal jaw of the packaging container producing equipment of FIG.1.
FIG. 8*b* is a view explaining a corrective feeding action thereof.

FIG. 8(*a*) is a view explaining the normal feeding action of web W and FIG. 8(*b*) is another view explaining a corrective feeding amount of web W. In the normal feeding action of web W in FIG. 8(*a*), web W is fed at the initial set value equivalent to the web feeding amount obtained by adding only 0.5 mm to the reference feeding amount (the feeding amount which becomes a reference set in design) at a folding angle A° of the lug folding flaps 7*c*.

Web feeding amount in the normal feeding action= Reference feeding amount +0.5 mm.

FIG. 8(*b*) shows the folding angle of the lug folding flaps 7*c* changed to angle B° for corrective feeding action of web W to secure an amount of feeding obtained by subtracting only 1.0 mm from the above-mentioned reference feeding amount.

Web feeding amount in the corrective feeding action Reference feeding amount −1.0 mm.

The above-mentioned web W feeding amounts [−1.0 mm] or [+0.5 mm] are used for only making the explanation more understandable. That is, the normal feeding action and corrective feeding action of the invention are not limited to these amounts.

Figures 9A, 9B, 9C:
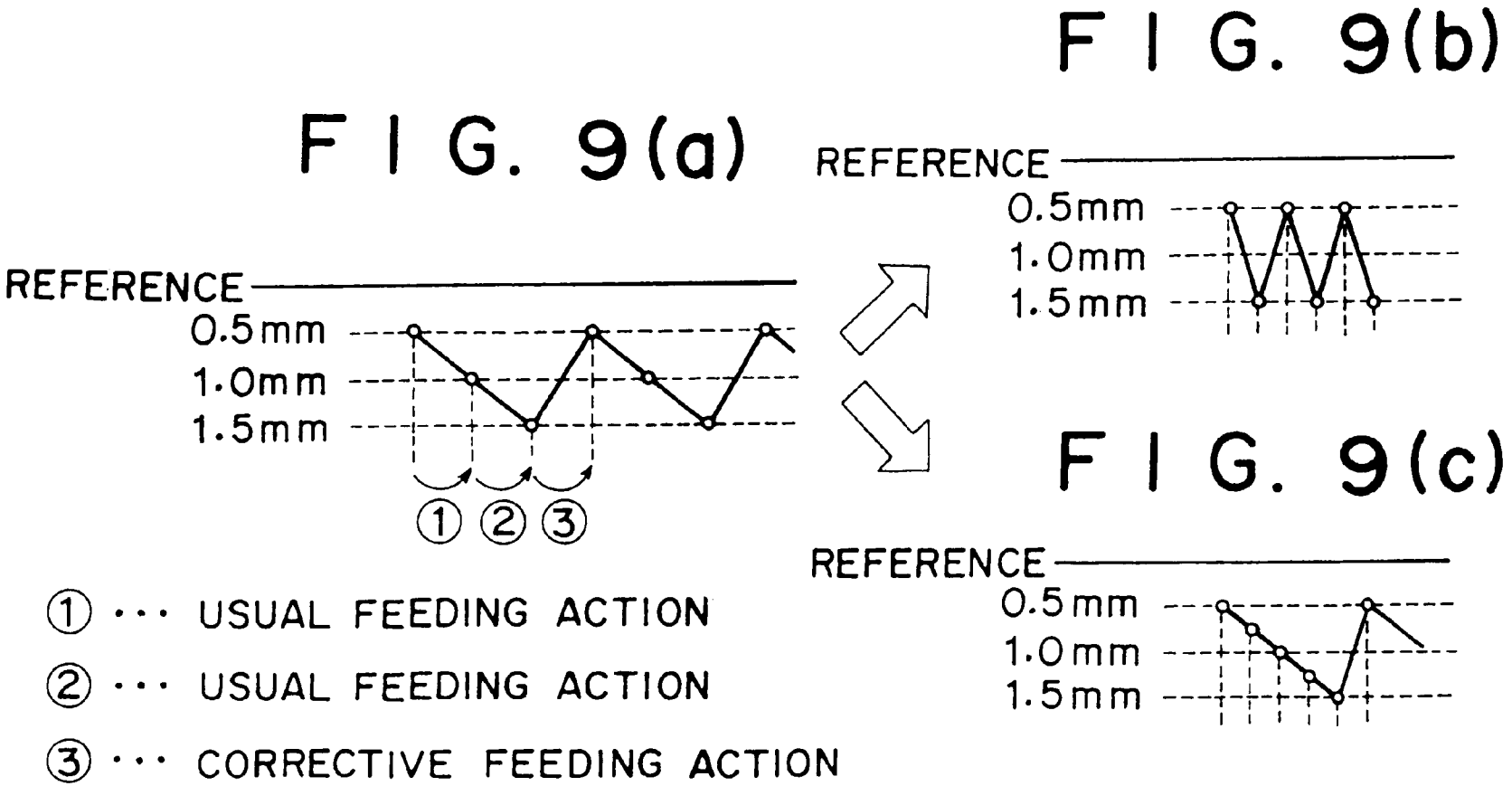
FIG. 9*a* to FIG. 9*c* illustrate patterns of movements consisting of a combination of the normal feeding action and corrective feeding action of FIG. 8.

Conventionally, the feeding of web W was controlled by only the abovementioned normal feeding action and corrective feeding action of the lug folding flaps 7*c*. For example, where it is assumed that there is no printing error (no slip of the detection mark a) of web W, and there is nothing abnormal in the feeding amount of the feeding roller 10, guide roller 11, etc., as shown in FIG. 9 (*a*), the folding angle of the lug folding flaps 7*c* is changed to angle B°, as shown in FIG. 8(*b*), and the action is changed to a corrective feeding action at the point of time (after the normal feeding action is performed two times) when web W is excessively fed 0.5 mm each by the abovementioned normal feeding amount made by the lug folding flaps 7*c* and web W is excessively fed 1.5 mm which is the allowance of slip from the reference feeding amount.

Web W, the slip of which became 0.5 mm from the reference feeding amount by the corrective feeding action, is returned to the normal feeding action again. In a case where there is no slip of the detection mark a such as a printing error of web W and there is nothing abnormal in the feeding amount of feeding roller 10, guide roller 11, etc., the above-mentioned corrective feeding amount is carried out once every three feeding actions (See FIG. 9 (*a*)).

However, since web W is excessively fed 0.5 mm per normal feeding action if a slip of the detection mark a of web W is, for example, +0.5 mm, the slip from the reference feeding amount in total becomes 1.5 mm per normal feeding action, wherein the feeding is changed to a corrective feeding action after the usual feeding action is performed once. Therefore, the corrective feeding action is executed once every two feeding actions as shown in FIG. 9(*b*). If the control device 23 judges that, in the normal feeding action, a slip from the reference feeding amount became 1.5 mm, the action is changed to the corrective feeding action.

Furthermore, since web W is excessively fed 0.5 mm in the normal feeding action if a slip of the detection mark a of web W is, for example, −0.25 mm each, the feeding action is separated 0.25 mm each from the reference position in one normal feeding action in total, and at the point of time when the slip from the reference feeding amount becomes 1.5 mm, the action is changed to a corrective feeding action. Therefore, as shown in FIG. 9(*c*), the corrective feeding action is executed once every five feeding actions.

(2) Method of adjusting the degree of tension applied to web W being transferred.

In order to accurately cause web W to move an appointed distance without fail by the method (1) of adjusting the web feeding amount by adjustment of the folding angle by the lug folding flaps 7*c*, it is necessary to give adequate fixed tension to web W by the tension pressing device 2 (FIG. 1).

If the abovementioned mark registration is carried out by only a combination of the method (2) with the method (1), there are a number of prior art problems which can not be solved.

To compensate for a change (error) of the feeding amount of web W, it is necessary that, for example, the average error of each time for every 100 pitches of the web feeding action equivalent to one packaging container C be less than an appointed value (for example +0.5 mm), and a change (error) of the feeding amount of web W per pitch of the web feeding action equivalent to one packaging container C does not exceed an appointed value (for example +1.5 mm). However, the further the consumption of roll-like web W progresses, the more frequently the feeding amount exceeds the allowable range for error in the mark registration of detection mark a, which is correctable by the method (1) of adjusting the amount of folding of web W in the transfer direction by the cross seal jaws 7.

For example, in the three patterns shown in FIG. 9(*a*) through FIG. 9(*c*), if a slip of the detection mark a from the reference feeding amount, for example due to an error in printing of web W, is +1.0 mm per pitch of the above-mentioned actions, the slip exceeds the allowable range for printing error, thereby causing faulty containers C to be produced. In some cases, packaging container producing equipment is unavoidably caused to come to a stop. Furthermore, if a slip of the detection mark a, due to an error in printing of the above-mentioned web w is continuously, for example, −0.5 mm or more per pitch, the slip goes beyond the reference feeding amount line (See FIG. 9) equivalent to the reference feeding amount, and correction of the amount of feeding of web W becomes impossible.

Thus, since the prior art range for adjustment of the feeding amount of web W is narrow, there is the problem that it is difficult to adjust the feed amount of web W while continuously running the equipment.

Therefore, in this preferred embodiment, the following construction is employed in order to increase the correctable range of error in registration of detection mark a on web W.

The method of this preferred embodiment escalationally controls the tension pressing force of the dancer roller 9 in multiple stages utilizing tension pressing device 2, or continuously controls the tension pressing force without any stages. In FIG. 2 and FIG. 7, a pneumatic cylinder 16 for driving a rocking arm rocking shaft 13 is positioned by a control valve 31 controlling air pressure thereto in multiple stages, for example three stages (strong, medium and weak), wherein the air pressure of the pneumatic cylinder 16 for driving the rocking arm rocking shaft is changed in compliance with an action pattern selected by the folding amount controlling means to change the tension applied onto web W, thereby adjusting the amount of feed of web W.

Figure 10:
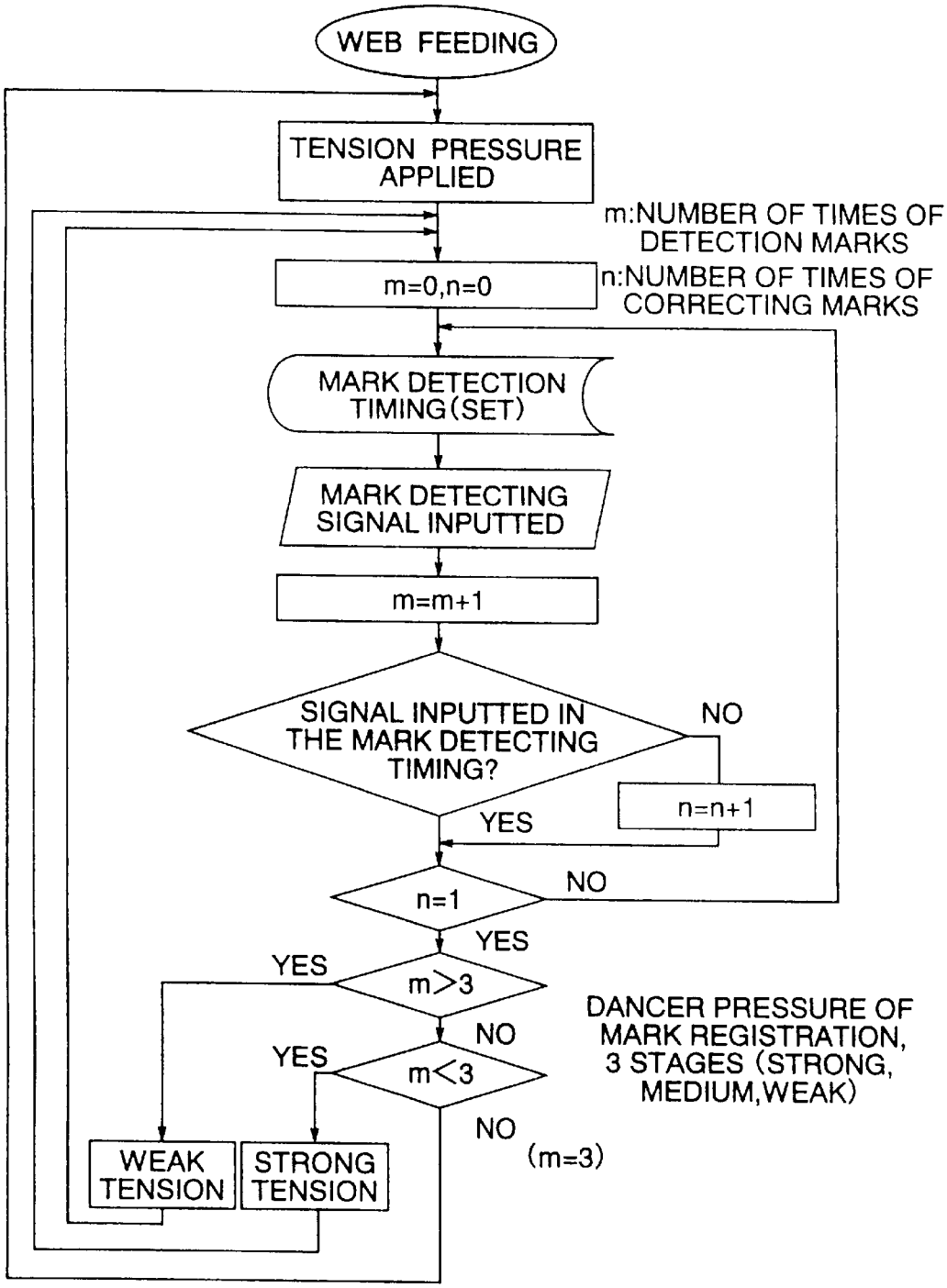
FIG. 10 is a flow chart of combined movements of the normal feeding action and corrective feeding action of the cross seal jaw of the packaging container producing equipment of FIG. 1.
Figure 11C:
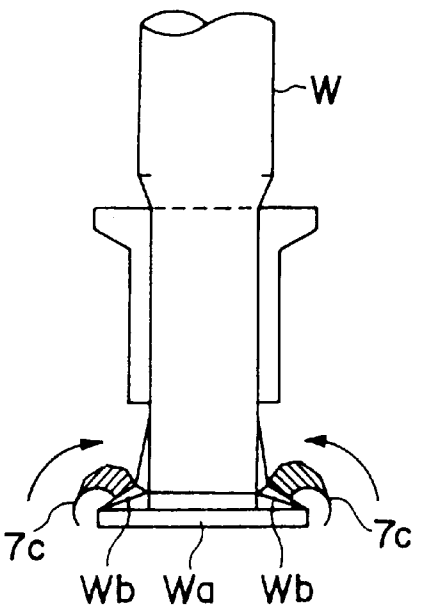
FIG. 11(c) (PRIOR ART)
FIG. 11*b* and FIG. 11*c* are perspective views taken along the line A—A in FIG. 11*a*.
Figure 11B:
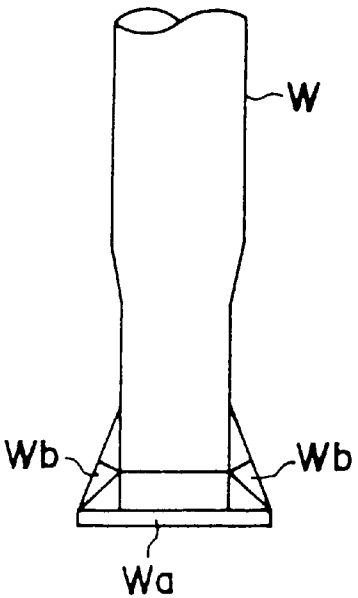
FIG. 11(b) (PRIOR ART)
Figure 11A:
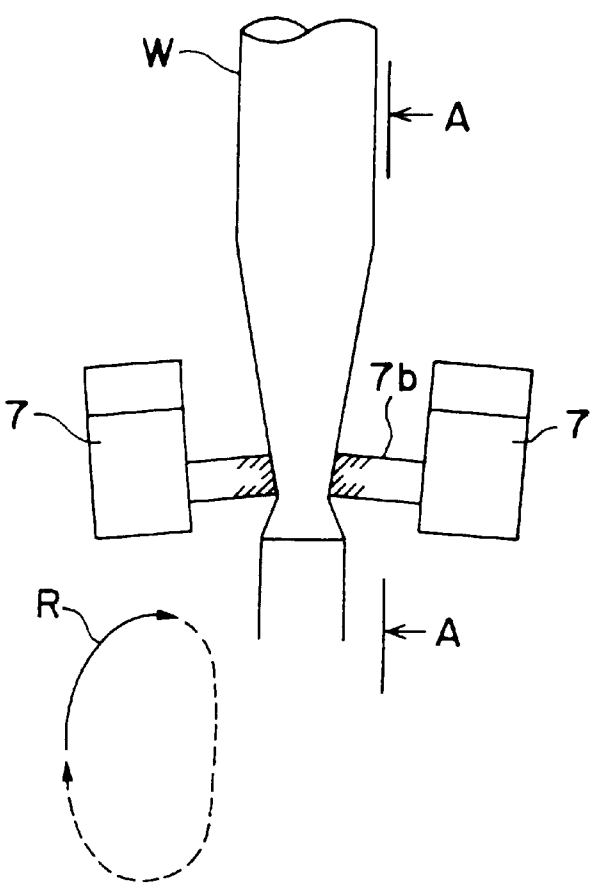
FIG. 11(a) (PRIOR ART)
FIG. 11*a* is an illustration of operation of the cross seal jaw of packaging container producing equipment.

The flow chart of FIG. 10 shows a method for controlling the feeding amount of web W by changing the web pressing force of the web tension pressing device 2 shown in FIG. 1, FIG. 2, etc., and FIG. 6 shows a control device 23 for controlling of the feeding amount of web W by changing the pressing force of the web tension pressing device 2.

After the air pressure of the cylinder 16 of the web tension pressing device 2 is set to medium, the control valve 31 changes the web W pressing force of the tension pressing device 2 to "Strong", "Medium", "Weak" in compliance with a signal by which a mark slip frequency detecting circuit 41 outputs a frequency of corrective feeding actions on the basis of a signal coming from a corrective value calculation circuit 38 which outputs an instruction signal for corrective feeding action or normal feeding action by the lug folding flaps 7*c*.

Thus, tension on web W is changed by using a pneumatic cylinder 16 for driving the rocking arm rocking shaft of the tension pressing device 2, wherein by changing the initial value of the feeding amount of the web W feeding roller 10, an error in printing web W is compensated, and the correctable range of the feeding amount of web W can be widened relative that of prior art, although the mechanical feeding amount of web W by a cross seal jaw 7 per time is fixed.

For example, as the fundamental setting of a detection mark error compensating (mark registration) mechanism is described in FIG. 9(*a*), it is assumed that there is nothing abnormal in the web feeding amount in the feeding roller 10, guide roller 11, etc., and a corrective feeding action (that is, the action of feeding web w by folding to angle B° aa shown in FIG. 8(*b*) reduces the feeding amount by 1.0 mm from the reference feeding amount) is carried out once after the normal feeding action of web W (the action of feeding web W) by folding to angle A° as in FIG. 8(*a*) to add 0.5 mm to the reference feeding amount) is continuously carried out two times exceeding 0.5 mm each, i.e., a corrective feeding action has been carried out ⅓. Then, the tension applied to the dancer roller 9 is set to, for example ION, and this state is regarded as a fundamental setting.

As the number of times of corrective feeding actions becomes ⅓ times halfway of executing continuous operation in this fundamental setting state, the control device 23 outputs a control signal, which sets the tension in web W to weak, to the control valve 31. That is, as the number of times of corrective feeding actions becomes ⅓, the web is expected to be excessively fed 0.5 mm per time (per pitch) by the normal feeding action. Therefore, it means that the web W has not been fed equivalent to only that amount. In other words, it means that the pitch of detection mark a (See FIG. 4) of web W is longer than the prescribed pitch, and when being observed from the detection mark a side of web W, it means that the web W has not been fed only the prescribed amount. At this time, it is judged that the tension applied to web W is strong, the control device 23 attempts to decrease the tension by action of the pneumatic cylinder 16 in repositioning the dancer roller 9. (For example, the fundamental setting 1ON is decreased to 8N.

As a result, even though the feeding amount of web W becomes great and a slip of the detection mark a of web W is, for example, −0.25 mm each for one pitch, a corrective feeding action of the pattern shown in FIG. 9(*a*) is carried out.

Furthermore, similarly, if the number of times of corrective feeding actions becomes ½ times shown in FIG. 9(*b*) halfway of executing continuous operation in the fundamental setting state, the control device 23 outputs a control signal for setting the tension onto web W to "strong" to the control valve 31. That is, in this case, it is judged that the tension applied to web W (packaging material) is weak, the pneumatic cylinder 16 of the dancer roller 9 operates so as to increase the tension. Thereby, even though the printing error (slip of detection mark a) of web W is, for example, +0.5 mm each, a correction feeding action of the pattern shown in FIG. 9(*a*) is carried out.

Thus, the allowable range with respect to a printing error (slip of detection mark) of web W and abnormality of the web feeding amount by the feeding roller 10, guide roller 11, etc., can be further widened as compared to the prior art.

Next, a description is given of another embodiment which is constructed so that the tension fluctuation is decreased by securing the amount of accumulation of tension of web W by further actuating the feeding roller 10 in two stages, high speed and low speed, in a case where the tension pressing force on the web is adjusted by a combination of normal feeding actions and corrective feeding actions of the web as described above.

Since the web transfer path is long, the web travels a complicated path with its transfer direction changed many times, and because the distance is long, feeding force of the feeding roller 10 is used in addition to the web transfer force of cross seal Jaw 7. However, it is remarkably difficult to have the feedrate of the web feeding roller 10 completely coincide with the web feedrate by the cross seal jaw 7.

Therefore, in order that the tension or feedrate of the web at the tension pressing device 2 including the feeding roller 10 does not influence the web feedrate at the cross seal jaw 7, it is necessary to secure the amount of accumulation by the tension pressing device 2 consisting of web feeding roller 10, etc., so as to correspond to changes in the feedrate of web W due to the action of the cross seal jaw 7. Accordingly, the present embodiment includes a rocking type dancer roller 9 which allows the feeding roller 10 to change between high-speed operation and low-speed operation. Thereby, the tension applied onto web W can be controlled and kept constant.

When the feeding roller 10 is operated at a low speed, the dancer roller 9 is slowly elevated, and when the dancer roller 9 reaches the upper dead point, the feeding roller 10 is changed to a high-speed operation to cause the feeding rate of the web to be increased. The dancer roller 9 is then slowly lowered. When the dancer roller reaches the lower dead point, it is changed to a low-speed operation again to cause the feedrate of web W to decrease. Then, the dancer roller 9 is elevated to cause the tension operating on the web W to be controlled and kept constant.

With reference to FIG. 2, although the feeding roller 10 is driven by a drive means 8 having a clutch, the transfer force for transport of web W is generated while the web W is being nipped between the feeding roller 10 and pressing roller 17. The pressing roller 17 is able to give a pressing force to the feeding roller 10 by using a fluid cylinder (not illustrated). Furthermore, rotation shaft 13 of the rocking arm 12 of the dancer roller 9 penetrates the wall of the germfree chamber 18, and an operating arm 20 is fixed outside the wall of the chamber. The operating arm 20 is elongated in a direction parallel to the rocking arm 12. The upper-limit position detector 21*a* and lower-limit position detector 21*b* are respectively provided at the outer wall side of the germfree chamber in the vicinity of the operating area at the distal end of the operating arm 20.

Although the driving means 8 of the feeding roller 10 is operated in two stages, high speed and low speed, web W is intermittently advanced in the process of forming it from tubular web W into hexahedral packaging containers C (FIG.1). If it is assumed that it is continuously advanced, the feeding amount per unit time is made a reference feeding amount. In this case, the operating speed of the driving means 8 is established so that the feedrate of web W by the feeding roller 10 exceeds the reference feedrate when the driving means 8 is operated at the high speed, and the feedrate of web W by the feeding roller 10 becomes less than the reference feedrate when the driving means 8 is operated at a low speed.

Since the feedrate of web W by the feeding roller exceeds the reference feedrate if it is assumed that the driving means 8 is operated at the high speed, the web W is slackened, and the slackening thereof is gradually increased, and the dancer roller 9 is caused to go down by the pressing force of the pneumatic cylinder 16.

Therefore, the rocking arm 12 rotates downward around its rotating shaft 13, and the operating arm 20 rotates in the same direction as that of the rocking arm 12 via its rotation shaft 13. In the meantime, as the distal end of the operating arm 20 reaches the position opposite the lower limit position detector 21*b*, the same detector 21*b* detects this. At this time, the same detector 21*b* outputs a lower limit position signal, and the control device 23 changes the high speed operation of the driving means 8 to the lower speed operation on the basis of the output signal.

Since the feedrate of web W by the feeding roller 10 becomes less than the reference feedrate at this time,, the slackening of web W is gradually decreased, and the dancer roller 9 is elevated by being pulled by the web W. At this time, the operating arm 20 rotates in the reverse of the abovementioned direction, and as the distal end of operating arm 20 comes to the position opposite the upper limit position detector 21*a*, the same detector 21*a* outputs an upper limit position signal, whereby the driving means 8 is changed from the low speed operation to the high speed operation again.

Thus, although the dancer roller 9 repeats vertical movements between the upper limit position and the lower limit position as detectors 21*a*, 21*b* detect the operating arm 20, web W is given tension resulting from the pressing force by the pneumatic cylinder 16 of the dancer roller 9 and the web W is continuously fed. Therefore, it is possible to keep the tension, applied onto the web W, fixed at all the times. Furthermore, since the upper limit and lower limit detectors 21*a*, 21*b* are disposed outside the germfree chamber 18, they are not affected by any trouble resulting from high temperature inside the germfree chamber 18.

As described above, according to the invention, in addition to operation of controlling the tension pressing force of web and operation of changing between high speed/low speed operations of the driving means of web feeding roller, the allowable range for correction of web feed amount by the cross seal jaws 7 can be widened relative to the prior art, and even if a change (error) of the feeding amount of web W is greater than in the conventional examples, no faulty products are produced.

What is claimed is;:

1. A packaging container making apparatus for forming tubular web from sheet-like web and producing packaging containers, comprising:

a web feeding roller for transporting the sheet-like web along a feed path in a direction lengthwise of the sheet-like web;

a web tensioning device including a rocking arm and a dancer roller secured at a distal end thereof, said dancer roller applying a pressing force against the sheet-like web, said rocking arm being mounted for pivoting between upper limit and lower limit positions;

a web tension pressing force setting means for setting a value for the pressing force applied by said tensioning device;

tube forming means for forming the sheet-like web into a tubular web;

a sealing member for sealing portions of the tubular web by pressing together opposing sides of the tubular web, said pressing forming a transverse sealed portion in said tubular web extending in the direction orthogonal to the lengthwise direction of the tubular web and forming lugs adjacent opposing ends of said transverse sealed portion;

mark detecting means for detecting registration of predetermined detection marks on the web with points of detection established in advance;

folding means for folding said lugs through an angle and for advancing the tubular web a distance corresponding to the angle of the folding of the lugs;

a folding amount controlling means for controlling said folding means by selecting an optimal mode of operation for said folding means from a plurality of modes of operation, responsive to a deviation in timing of detection of the registration; and rocking arm drive means connected to said rocking arm for adjusting the value for pressing force set by said web tension pressing force setting means according to the mode of operation selected as optimal by the folding amount controlling means.

2. The packaging container making apparatus of claim 1 wherein said folding amount control means controls said folding means to fold said lugs either in a normal mode of operation, through a first angle which advances the tubular web through a distance exceeding a reference distance or, in a correction mode of operation, through a second angle which advances the tubular web through a distance less than the reference distance.

3. The packaging container making apparatus of claim 2 wherein the web tension pressing force controlling means raises the value set by the web tension pressing force setting means when the folding members are operated in the correction mode more frequently than a predetermined frequency, and lowers the value set by the web tension pressing force setting means when the folding members are operated in the correction mode less frequently than the predetermined frequency.

4. The packaging container making apparatus of claim 1 wherein the sealing members nip the tubular web at a first position and pull it a predetermined distance to a second position, seal the area nipped between the two sealing members, release the tubular web at the second position and return to the first position to again nip the tubular web and repeat the pulling, sealing and releasing steps.

5. The packaging container making apparatus of claim 1 wherein said rocking arm drive means is a fluid-operated cylinder.

6. The packaging container making apparatus of claim 5 further comprising:

position detecting means for detecting the presence of the rocking arm at the upper-limit position and at the lower-limit position; and means for changing the web feeding roller between a high-speed operation and a low-speed operation in accordance with detection of the rocking arm at the upper-limit position or at the lower limit position.

7. A method for forming a tubular web from sheet-like web and for producing packaging containers from the tubular web, comprising:

transporting the sheet-like web along a feed path in a direction lengthwise of the sheet-like web;

tensioning the sheet-like web within the feed path by pressing a dancer roller against the sheet-like web, the dancer roller being secured at a distal end of a rocking arm and pivoting between upper limit and lower limit positions;

setting a value for the pressing force applied by the dancer roller;

forming the sheet-like web into a tubular web;

sealing transverse portions of the tubular web by pressing together opposing sides of the tubular web, said pressing forming a transverse sealed portion in said tubular web extending in the direction orthogonal to the lengthwise direction of the tubular web and forming lugs adjacent opposing ends of said transverse sealed portion;

detecting registration of predetermined detection marks on the web with points of detection established in advance;

folding the lugs through an angle thereby advancing the tubular web a distance corresponding to the angle of the folding of the lugs;

selecting an optimal mode of operation for said folding from a plurality of modes of operation, responsive to a deviation in timing of detection of the registration; and driving the rocking arm to adjust the value set for the pressing force according to the selected mode of operation.

8. The method of claim 7 further comprising:

switching between a normal folding action advancing the tubular web a distance exceeding a reference distance and a corrective folding action advancing the tubular web a distance less than the reference distance, in accordance with the detecting.

9. The method of claim 8 wherein:

the value for pressing force is set at a first level when the corrective folding actions are carried out more frequently than a predetermined frequency, and is set at a second level, lower than said first level, when the corrective folding actions are carried out less frequently than the predetermined frequency.

10. The method of claim 7 further comprising:

detecting presence of the dancer roller at the upper limit and lower limit positions; and switching said transporting of the sheet-like web between a high-speed operation and a low-speed operation responsive to detection of the dancer roller at the upper-limit position and the lower-limit position.

11. The method of claim 7 wherein the pressing force on the web is controlled stepwise.

12. The method of claim 7 wherein the pressing force on the web is continuously variable.

* * * * *